US007246386B2

(12) United States Patent
Hall

(10) Patent No.: US 7,246,386 B2
(45) Date of Patent: Jul. 24, 2007

(54) WASTE OUTLET ASSEMBLY

(75) Inventor: Kelvin E. Hall, Kent (GB)

(73) Assignee: Enviro-Fresh Limited (GB)

( * ) Notice: Subject to any disclaimer, the term of this patent is extended or adjusted under 35 U.S.C. 154(b) by 0 days.

(21) Appl. No.: 10/471,238

(22) PCT Filed: Mar. 11, 2002

(86) PCT No.: PCT/GB02/01082

§ 371 (c)(1),
(2), (4) Date: Feb. 16, 2004

(87) PCT Pub. No.: WO02/072967

PCT Pub. Date: Sep. 19, 2002

(65) Prior Publication Data

US 2004/0163171 A1 Aug. 26, 2004

(30) Foreign Application Priority Data

Mar. 9, 2001 (GB) ..... 0105842.9

(51) Int. Cl.
*E03D 13/00* (2006.01)

(52) U.S. Cl. ..... 4/301; 4/679; 4/287; 4/286

(58) Field of Classification Search ..... 4/301, 4/309, 311, 679, 681, 222, 286, 287, 292, 4/294

See application file for complete search history.

(56) References Cited

U.S. PATENT DOCUMENTS 1,751,877 A * 3/1930 Nance ..... 4/679
2,472,322 A * 6/1949 Weissman ..... 210/163
3,725,964 A * 4/1973 Whitsett ..... 4/679
4,045,346 A * 8/1977 Swaskey ..... 210/164
4,224,701 A * 9/1980 Huang ..... 4/679
4,244,061 A * 1/1981 Webster et al. ..... 4/DIG. 14
6,701,541 B2 * 3/2004 Romagna et al. ..... 4/301

FOREIGN PATENT DOCUMENTS

EP 0138796 A1 * 4/1985

* cited by examiner

*Primary Examiner*—Khoa D. Huynh
(74) *Attorney, Agent, or Firm*—Connolly Bove Lodge & Hutz LLP

(57) ABSTRACT

The present invention relates to a waste outlet assembly, in particular a waste outlet assembly for a urinal of the type commonly found in men's lavatories. There is described an elongate cylindrical insert having an operatively upper end and an operatively lower end and being insertable into the waste outlet of a urinal bowl or trough, which outlet includes a liquid trap, wherein the insert is radially dimensioned to provide a close fit against the walls of the waste outlet; and wherein the insert is longitudinally dimensioned such that, in use, the lower end extends into liquid in the liquid trap. There is also described a urinal including such an insert. The present invention also provides a process for reducing the emission of odours from a urinal having a liquid seal trap, the method comprising inserting a cylindrical element into the outlet of the urinal wherein the elongate element is radially dimensioned to provide a close fit against the walls of the waste outlet; and wherein the elongate element is longitudinally dimensioned such that, in use, a lower end thereof extends into liquid in the liquid trap.

5 Claims, 4 Drawing Sheets

WASTE OUTLET ASSEMBLY

The present invention relates to a waste outlet assembly, in particular a waste outlet assembly for a urinal of the type commonly found in men's lavatories.

Conventionally, the bowl or trough of a urinal is provided with a water seal trap, in the form of a P-bend trap or a bottle trap, to prevent egress of foul sewer gases into washroom areas. However, limescale tends to accumulate upon the internal surfaces of the trap and waste outlet. Additionally, reactions between minerals in the water, particularly in hard water areas and uric acid in the urine generate uric acid salts which also tend to accumulate on the surfaces of the trap and outlet. Where these accumulate above the water level in the trap, foul odours are still emitted into the washroom area.

The inventors in WO99/07953 seek to solve this problem by proposing a waterless urinal waste system in which the outlet is equipped with a one-way valve, thus avoiding the need for a water seal trap.

However, there is a prejudice amongst users against waterless urinals, urinals that do not incorporate a conventional flushing arrangement to periodically rinse the urinal bowl or trough. Accordingly, the present invention seeks to solve the above problem in a manner which is compatible with existing flushing urinals, which typically include a liquid trap.

In its broadest sense, the present invention provides an elongate cylindrical insert having an operatively upper end and an operatively lower end and being insertable into the waste outlet of a urinal bowl or trough, which outlet includes a liquid trap, wherein the insert is radially dimensioned to provide a close fit against the walls of the waste outlet; and wherein the insert is longitudinally dimensioned such that, in use, the lower end extends into liquid in the liquid trap.

The present invention also provides a urinal having a bowl or trough and including an outlet therefrom, which outlet includes a liquid trap, wherein the urinal includes an elongate cylindrical insert having an operatively upper end and an operatively lower end and being insertable into the waste outlet of the urinal bowl or trough, and which outlet includes a liquid trap, wherein the insert is radially dimensioned to provide a close fit against the walls of the waste outlet; and wherein the insert is longitudinally dimensioned such that, in use, the lower end extends into liquid in the liquid trap.

The present invention also provides a process for reducing the emission of odours from a urinal having a liquid seal trap, the method comprising inserting a cylindrical element into the outlet of the urinal wherein the elongate element is radially dimensioned to provide a close fit against the walls of the waste outlet; and wherein the elongate element is longitudinally dimensioned such that, in use, a lower end thereof extends into liquid in the liquid trap.

Preferably, the upper end of the insert is adapted to receive a deodorising and/or descaling or neutralising composition, typically in the form or a solid or gel block.

The above and other aspects of the present invention will now be described in further detail, by way of example only, with reference to the accompanying drawings, in which.

Figure 1:
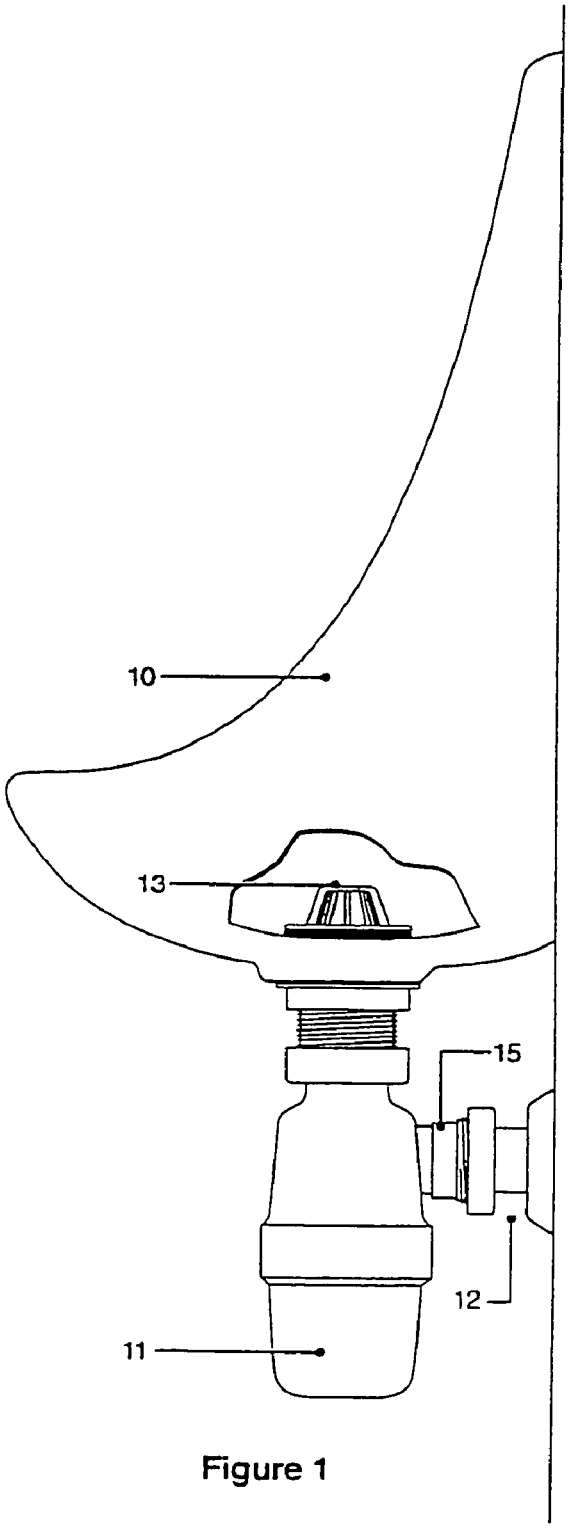
FIG. 1 is a schematic side view of a conventional urinal bowl including a waste outlet.
Figure 2:
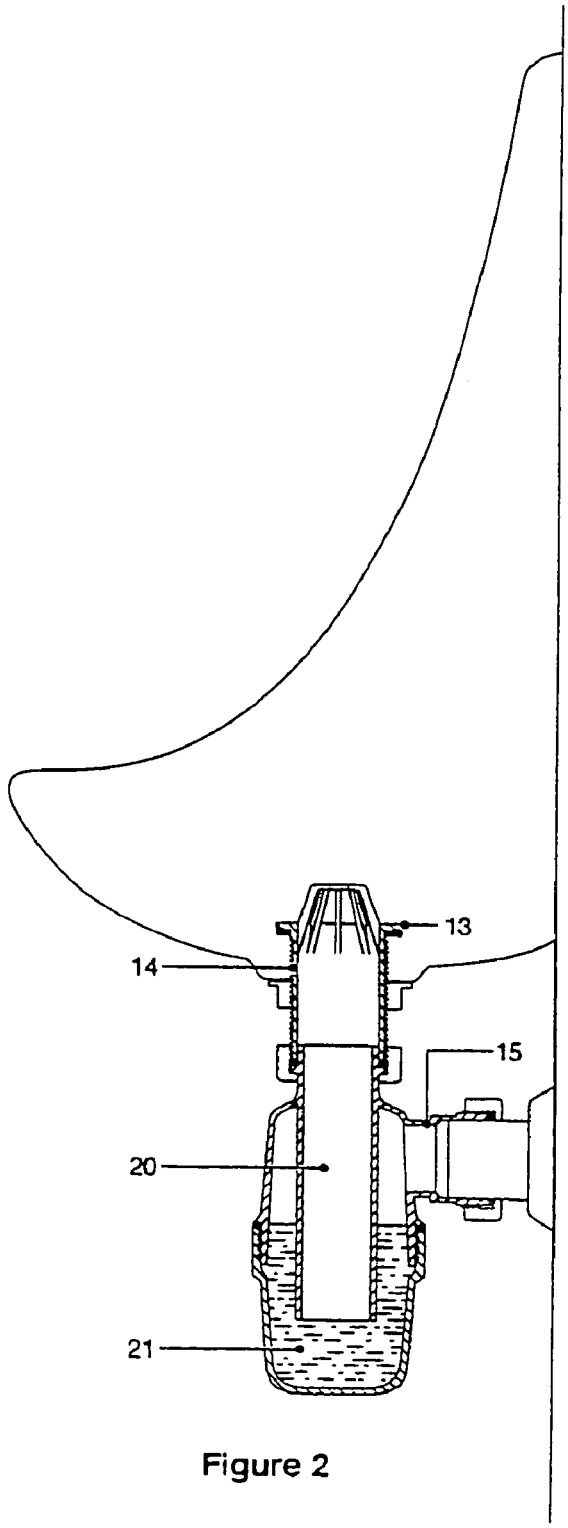
FIG. 2 is a schematic cross-section of a conventional urinal bowl including waste outlet.

Referring to FIGS. 1 and 2, conventionally a urinal of the type frequently encountered in a gentlemen's lavatory includes a bowl 10 coupled via a water seal trap, as shown, a bottle trap 11, to a waste pipe 12 which leads to a sewerage system. A waste outlet 13 is inserted into an aperture formed in the lowermost part of the urinal bowl. Waste outlet 13 has a threaded tail 14 such that the outlet is secured in place in the aperture of the urinal by means of a nut 16. As is conventional, seals 17 are provided above and below the urinal bowl to prevent egress of liquid. The inlet of the bottle trap 11 is also secured onto the tail end 14 of the waste outlet 13. The bottle trap 11 includes a horizontal outlet 15 couplable to the waste pipe 12. The inlet of the bottle trap includes a vertical pipe 20, the lower end of which pipe extends below the lower edge of horizontal outlet 15. This arrangement allows water 21 to be retained within the trap up to the level of the bottom edge of horizontal outlet 15 thus preventing foul gases from passing from the waste pipe 12 to the urinal bowl 10 and thence to the atmosphere in the lavatory area.

Figure 3:
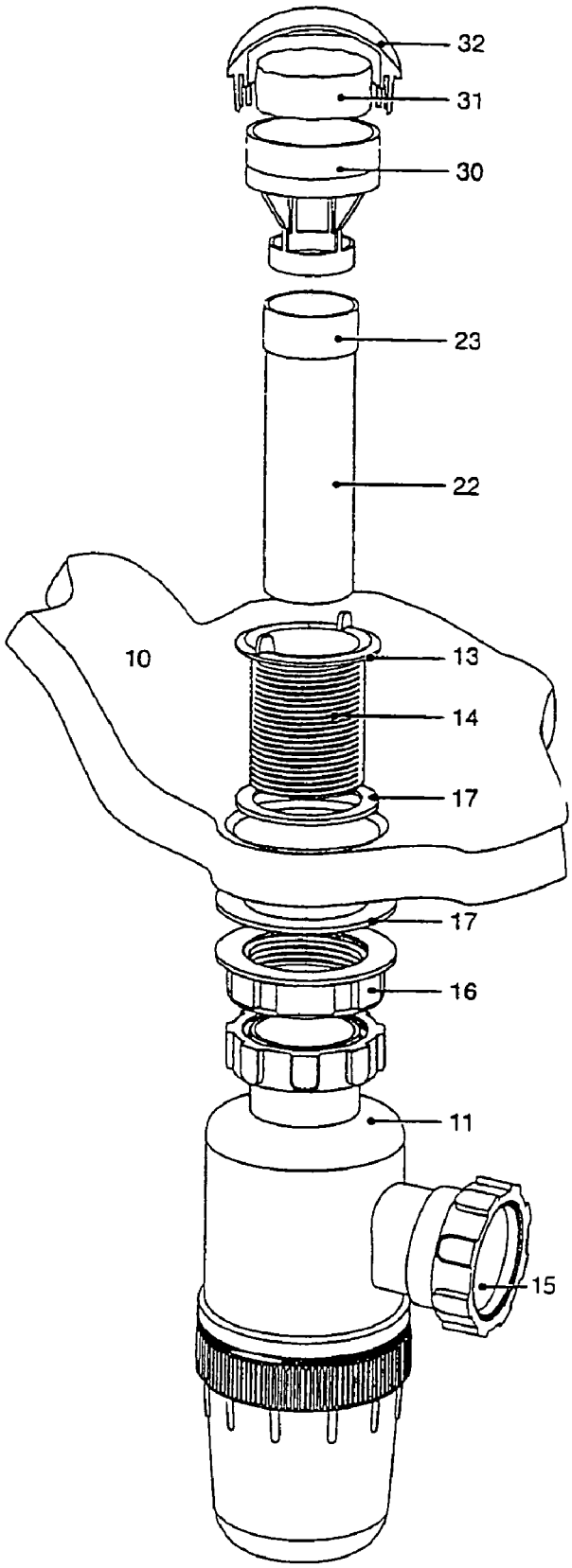
FIG. 3 is an exploded part-sectional view of an embodiment of a urinal assembly in accordance with the second aspect of the present invention.
Figure 4:
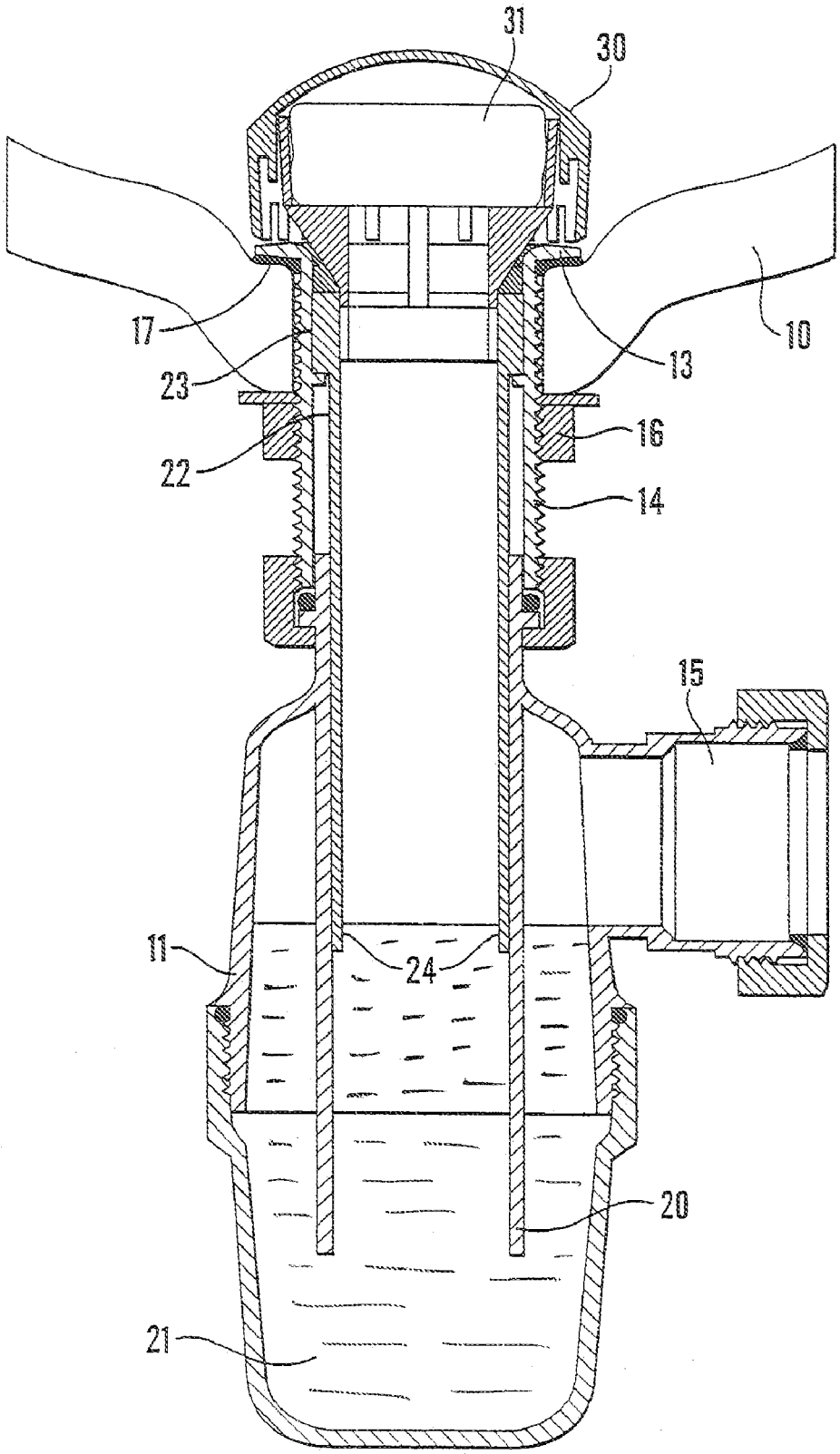
FIG. 4 is cross-sectional view of the urinal assembly of FIG. 3 in an assembled configuration.

With reference to FIGS. 3 and 4, the present invention provides an insert 22 of generally cylindrical appearance. The insert 22 is radially dimensioned such that the outer surface of the insert forms a close fit against the inner surfaces of the waste outlet 13 and the internal pipe 20 of the bottle trap. The upper end 23 of the insert 22 is shaped to match the contours of the waste outlet 13. The insert 22 is longitudinally dimensioned such that the lower end 24 of the insert 22 extends into the water 21.

As shown, the upper end 23 of the insert 22 may also be adapted to receive and engage a cover element 30. Such adaptation may be achieved by means of inter-cooperating elements on the respective components, or, in the embodiments shown, simply by means of one element being a push-fit upon the other. Cover element 30 acts to prevent ingress of solid matter and preferably incorporates a solid or gel block 31 incorporating a deodorising and/or descaling or neutralising composition under a cap 32. In an alternative embodiment, the cover element 30 is moulded integrally with the insert 22.

The insert of the present invention acts to reduce odours in two ways. Firstly, the junctions between the various components of the waste unit (waste outlet 13 and bottle trap 11) are prime areas upon which accumulation of uric acid salts occurs. The insert 22 prevents admission of urine to these areas. To a certain extent, the insert can be considered as providing a smoother interior surface to the waste outlet assembly to which it is more difficult for accumulations of uric acid salts to begin. Primarily, however, it is recognised that accumulations of uric acid salts will, over the course of time, still occur upon the insert 22. As the insert 22 is inserted into position from within the urinal bowl, it can readily be replaced on a periodic basis without requiring dismantling of the urinal waste outlet assembly. Initial tests show that the insert can remain in place for a period of around 3 months before replacement is indicated. Hitherto, removal of uric acid salts would have required removal of the bottle trap 11 and of the waste trap 13 from the urinal bowl 10 for internal cleaning. Thus the present invention provides significant advantages in terms of ease of removal of uric acid salts and time taken for that task.

In a preferred embodiment, the inner surface of the insert 22 is coated with a liquid treatment composition, suitably to solubilise otherwise insoluble uric acid salts thereby enabling the salts to be flushed through the urinal, either by flow of urine alone in a waterless installation, or water flow in a flushed system. The composition may, for example, include an enzymatic and/or bactericidal composition. The composition may alternatively or additionally include a water-softening composition.

Whilst the present invention has been illustrated with reference to a urinal having a bottle trap, it will be appreciated that the present invention is equally suitable for use with P-bend or S-bend traps.

Figure 5:
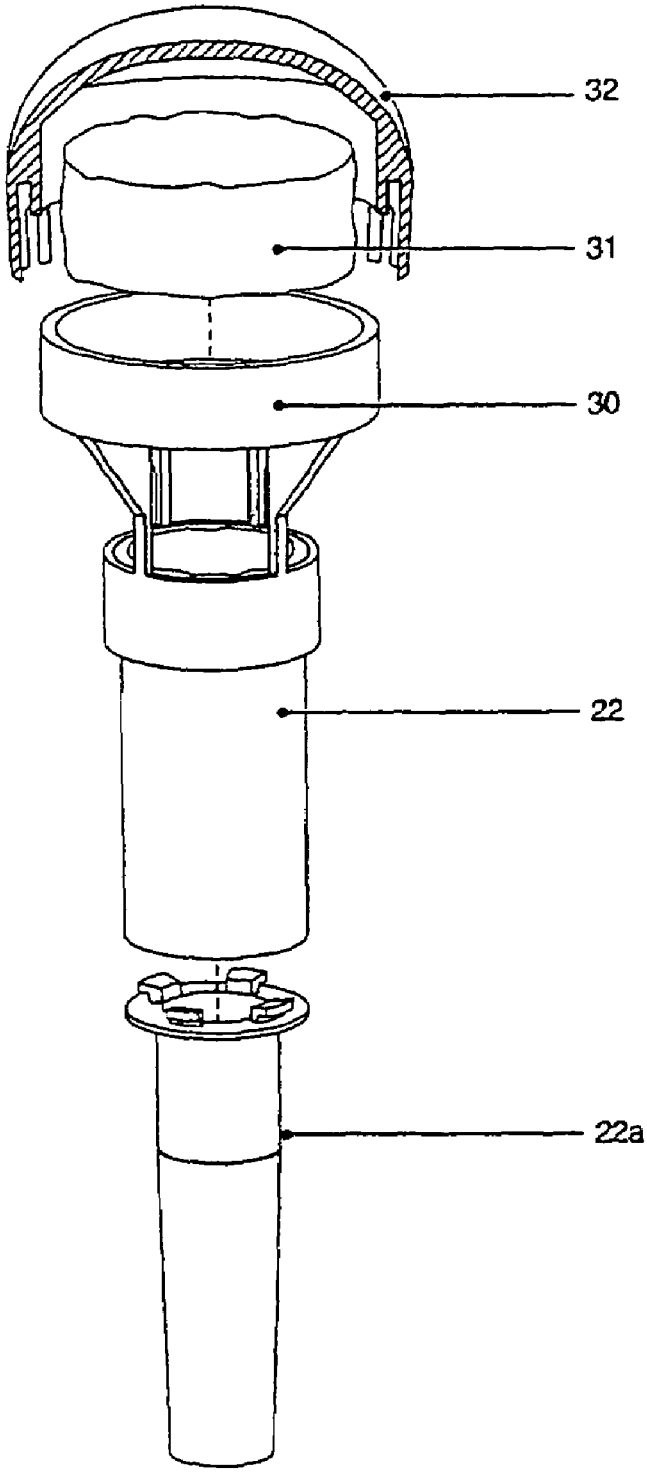
FIG. 5 is an exploded view of an alternative embodiment of a urinal insert in accordance with the present invention.

FIG. 5 illustrates a modification of the arrangement described above wherein the insert 22 includes an extender element 22*a* fittable to the body of the insert 22 by suitable means such as, in the embodiment shown, a bayonet-type fitting. In practice, a range of extender elements having different lengths will be available to suit all installations.

It must also be appreciated that the insert of the present invention is suitable for use in any urinal system incorporating a trap. Whilst the present invention was particularly designed for use in conventional flushed urinal systems, the insert will provide benefits in waterless systems. For example, rather than a complex valve system as is proposed in WO99/07953, a waterless system can be provided with a trap in which urine provides the liquid seal to prevent gases passing from the sewerage system into the urinal bowl. Advantageously, the block 31 in such situations will include a neutralising agent.

The invention claimed is:

1. A urinal outlet assembly for connecting the outlet of a urinal to a waste pipe comprising:

a waste outlet connected to an opening in the bottom of a urinal basin;

a liquid seal odor trap having one end connected to said waste pipe, and another end connected by an internal pipe to said waste outlet; and a replaceable cylindrical insert inserted through said opening in said urinal basin, said cylindrical insert having an upper end and an open bottom end, said cylindrical insert extending from said waste outlet into said internal pipe and into said liquid seal odor trap internal pipe, said open bottom end of said cylindrical insert extending into and contacting liquid in said liquid seal odor trap when in use, said cylindrical insert forming a substantially internal smooth surface for liquids which flow between said waste outlet and said liquid seal odor trap, and said cylindrical insert forming a close radial fit against inner surfaces of said waste outlet at said upper end and against inner surfaces of said internal pipe at said open bottom end, thereby preventing liquid from contacting said inner surfaces of said waste outlet and of said internal pipe, and preventing the formation of salts in said inner surfaces of said waste outlet and of said internal pipe.

2. An assembly as claimed in claim 1 in which the liquid trap is a bottle trap or P-trap.

3. The apparatus of claim 1 wherein a liquid treatment composition is formed on the inner surface of the insert.

4. The apparatus of claim 1 wherein the insert further comprises an extender element increasing the length thereof.

5. A method for reducing the emission of odors from a urinal having a liquid seal odor trap, said liquid seal odor trap having one end connected to a waste pipe and another end connected by an internal pipe to a waste outlet of said urinal, the method comprising: connecting said waste outlet to an opening in the bottom of a urinal basin, forming a substantially smooth internal surface between said waste outlet of said urinal and said liquid seal odor trap by inserting a removable cylindrical insert through said opening and into said waste outlet of said urinal such that: said cylindrical insert extends from said waste outlet into said internal pipe and into said liquid seal odor trap; said cylindrical insert having an upper end and an open bottom end; said cylindrical insert forms a close radial fit against inner surfaces of said waste outlet at said upper end and against inner surfaces of said internal pipe at said open bottom end; said cylindrical insertextends longitudinally such that, in use, said open bottom end of said cylindrical insert extends into and contacts the liquid in the liquid seal odor trap; and said cylindrical insert prevents liquid from contacting said inner surfaces of said waste outlet and of said internal pipe, and thereby preventing the formation of salts in said inner surfaces of said waste outlet and of said internal pipe.

* * * * *